US005870977A

United States Patent [19]

Adamovski

[11] Patent Number: 5,870,977

[45] Date of Patent: Feb. 16, 1999

[54] BOILER WITH CONDUCTIVE PIPE LINING AND CONTAINING MAGNETIC GRANULES

[75] Inventor: Victor Isaevich Adamovski, Petah Tikvah, Israel

[73] Assignee: New Devices Engineering a.k.a. Ltd., Petah Tikvah, Israel

[21] Appl. No.: 854,705

[22] Filed: May 12, 1997

[51] Int. Cl.[6] ..... F22B 37/48

[52] U.S. Cl. ..... 122/401; 122/379; 122/406.1

[58] Field of Search ..... 122/379–380, 122/387, 401, 406.1

[56] References Cited

U.S. PATENT DOCUMENTS

| | | | |
|---|---|---|---|
| 846,051 | 3/1907 | Ray | 122/401 |
| 1,625,197 | 4/1927 | Eisenhauer | 122/401 |
| 2,994,480 | 8/1961 | Carter | 122/401 |
| 5,575,244 | 11/1996 | Dethier | 122/406.1 |

*Primary Examiner*—Teresa J. Walberg
*Assistant Examiner*—Gregory A. Wilson
*Attorney, Agent, or Firm*—Mark M. Friedman

[57] ABSTRACT

A boiler in which water is heated by passing through a furnace has a plurality of pipes for carrying water through the furnace. Each pipe is formed from high-carbon steel and is provided with a non-magnetic, electrically conductive inner lining. The lining, which is preferably electrically grounded, may be formed for example from copper metal, copper-filled organosilicon or copper-filled fluoroplastic material. In an alternative, or supplementary, implementation of the invention, the water circulation system of the boiler is provided with a plurality of magnetized granules. The granules, which preferably have a density of between about $0.5\times10^3$ and about $1.0\times10^3$ kg $m^{-3}$, are carried through the boiler pipes by the water flow and help to reduce corrosion and scale deposition within the pipes.

19 Claims, 3 Drawing Sheets

BOILER WITH CONDUCTIVE PIPE LINING AND CONTAINING MAGNETIC GRANULES

FIELD AND BACKGROUND OF THE INVENTION

The present invention relates to boilers in which water is heated by passing through a furnace and, in particular, it concerns features for minimizing hydrogen embrittlement and scale deposition in heat-exchange pipes of such boilers.

A number of factors limit the operational efficiency of modem steam-generating and hot-water boilers. Amongst the foremost of these factors are the problems of hydrogen embrittlement and of scale deposition.

Firstly, with respect to hydrogen embrittlement, hot water and steam generating pipes of steam-generating and hot-water boilers are conventionally made from expensive, heat-resistant high-carbon steels. The strong magnetic fields generated by flames within the furnace of the boiler result in magnetization of these pipes. Under the high temperature and pressure present within the pipes, partial dissociation of water molecules occurs and hydrogen atoms interact with the surfaces of the magnetized high-carbon pipes displacing the carbon atoms from the metal lattice and causing the effect known as hydrogen embrittlement of the heat-exchange pipes.

As a result primarily of hydrogen embrittlement, the life expectancy of heat-exchange pipes in steam-generating and hot-water boilers is usually no more than 8–10 years. During this period, cracks may develop in the most heat-stressed regions, resulting in down-time of the boiler. This possibility generally requires that an emergency team of repairmen be available at all times, and that frequent inspections are conducted to detect magnetized sections of pipe for their timely replacement.

A second major factor which complicates operation of boilers and lowers their efficiency is the constant formation of scale in heat-stressed regions of the heat-exchange pipes. Scale deposits greatly increase the thermal resistance of the pipes, thereby reducing the efficiency of heat exchange. The deposition of scale also necessitates regular washing out of the tubes, typically once or twice a month, as well as intermittent overhaul. Washing out of the tubes requires significant boiler down-time, thereby reducing profitability. Overhaul is a very expensive process which, for modern large-scale boilers weighing thousands of tons, may take several months.

There is therefore a pressing need for steam-generating and hot-water boilers with features for reducing hydrogen embrittlement and scale accumulation, thereby increasing the lifetime of the boiler and reducing the frequency of service interruptions in the boiler operation. It would also be advantageous to provide a method of operating a boiler to achieve similar goals.

SUMMARY OF THE INVENTION

The present invention relates to a steam-generating or hot-water boiler which has heat exchange pipes provided with a non-magnetic electrically-conductive inner lining and/or contains a plurality of magnetized granules. The invention also relates to corresponding methods of operation of a boiler.

According to the teachings of the present invention there is provided, a boiler in which water is heated by passing through a furnace, the boiler comprising a plurality of pipes for carrying water through the furnace, each of the pipes being formed from high-carbon steel and being provided with a non-magnetic, electrically conductive inner lining.

According to a further feature of the present invention, the inner lining is a copper coating.

According to a further feature of the present invention, the inner lining includes copper-filled organosilicon.

According to a further feature of the present invention, the inner lining includes copper-filled fluoroplastic material.

According to a further feature of the present invention, the inner lining is electrically grounded.

According to a further feature of the present invention, the pipes form part of a water circulation system which has an inner volume, and the boiler also includes a plurality of magnetized granules located within the inner volume.

There is also provided according to the teachings of the present invention, a boiler in which water is heated by passing through a furnace, the boiler comprising: (a) a water circulation system including a plurality of pipes for carrying water through the furnace, the water circulation system defining a contained volume; and (b) a plurality of magnetized granules located within the inner volume.

According to a further feature of the present invention, the granules have a density of between about $0.5\times10^3$ and about $1.0\times10^3$ kg $m^{-3}$.

According to a further feature of the present invention, the total volume of all of the granules corresponds to between about 15% and about 70% of the inner volume.

According to a further feature of the present invention, the granules are made from magnetic porous glass.

According to a further feature of the present invention, the granules are made from ceramic material with a magnetic filler.

According to a further feature of the present invention, the granules are made from a thermo-stable polymeric material with a magnetic filler.

According to a further feature of the present invention, the granules are substantially spherical with diameters of between about 1 and about 10 mm.

According to a further feature of the present invention, there is also provided a device for delivering the granules into the inner volume.

According to a further feature of the present invention, each of the pipes is formed from high-carbon steel with a non-magnetic, electrically conductive inner lining.

There is also provided according to a further feature of the present invention, a method for operating a boiler having a water circulation system including a plurality of pipes for carrying water through a furnace, the water circulation system defining a contained volume, the method comprising feeding into the inner volume a plurality of magnetized granules.

According to a further feature of the present invention, the granules have a density of between about $0.5\times10^3$ and about $1.0\times10^3$ kg $m^{-3}$.

According to a further feature of the present invention: (a) some of the granules of which the effective density has been increased by deposition of scale are removed; and (b) replacement magnetic granules are supplied into the inner volume.

According to a further feature of the present invention, the total volume of all of the granules is maintained between about 15% and about 70% of the inner volume.

According to a further feature of the present invention, the total volume of all of the granules is maintained between about 15% and about 45% of the inner volume.

According to a further feature of the present invention, the granules have a heat capacity of less than about one tenth of that of water, and wherein the total volume of all of the granules is maintained between about 50% and about 70% of the inner volume.

According to a further feature of the present invention, the granules are made from magnetic porous glass.

According to a further feature of the present invention, the granules are made from ceramic material with a magnetic filler.

According to a further feature of the present invention, the granules are made from a thermo-stable polymeric material with a magnetic filler.

According to a further feature of the present invention, the granules are substantially spherical with diameters of between about 1 and about 10 mm.

BRIEF DESCRIPTION OF THE DRAWINGS

The invention is herein described, by way of example only, with reference to the accompanying drawing, wherein.

DESCRIPTION OF THE PREFERRED EMBODIMENTS

Figure 1:
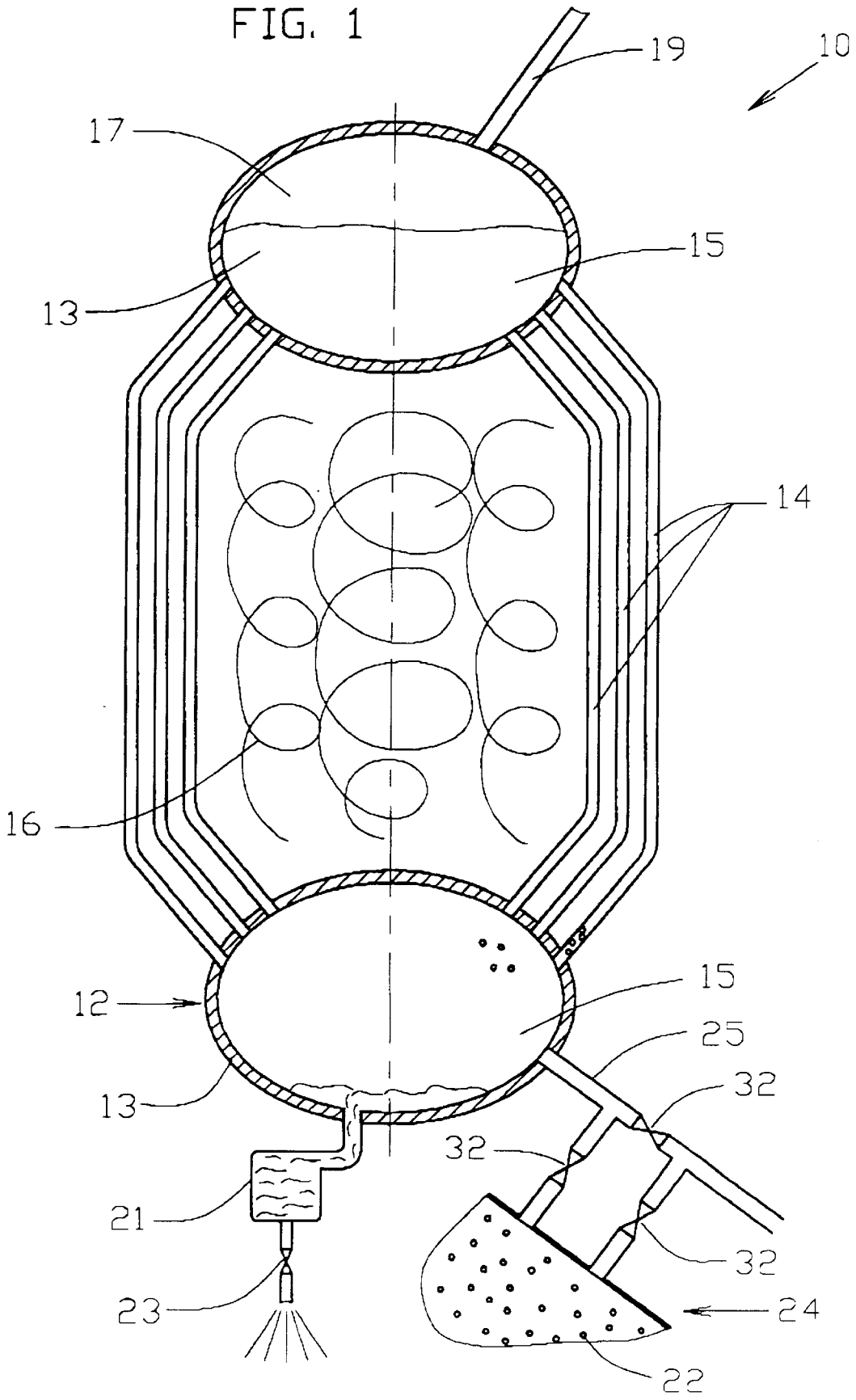
FIG. 1 is a schematic diagram of a boiler, constructed and operative according to the teachings of the present invention.

The present invention relates to a steam-generating or hot-water boiler which has heat exchange pipes provided with a non-magnetic electrically-conductive inner lining and/or contains a plurality of magnetized granules. The invention also relates to corresponding methods of operation of a boiler.

The principles and operation of boilers according to the present invention may be better understood with reference to the drawing and the accompanying description.

Referring now to the drawing, FIG. 1 shows a boiler, generally designated 10, constructed and operative according to the teachings of the present invention.

Generally speaking, the present invention relates to two sets of features each of which may be used separately to advantage, but which are preferably used in synergy to give profound reductions in both hydrogen embrittlement and scale deposition in boiler heat-exchange pipes. The first set of features relates to providing a non-magnetic electrically conductive lining to the heat exchange pipes, while the second relates to the supply of magnetized granules into the inner volume of the boiler.

It will be noted that various physical mechanisms are suggested throughout the description by which the present invention is thought to operate. However, it should be emphasized that the mechanisms described are presented exclusively to help the reader's understanding and should not be understood to limit the scope of the invention in any way.

The invention is applicable to any situation in which heat-exchanger pipes subjected to high temperatures and/or pressures are made from ferromagnetic steels. Examples of field of application include, but are not limited to, steam generators, boiler plants and thermal power stations.

By way of introduction, it has been found that resistance of heat exchange pipes to corrosion is greater for pipes made from metal with a high coercivity, i.e., which is less easily magnetized. Correspondingly, it has been found that corrosion-damaged pipes in boilers exhibit higher residual magnetization than similar adjacent pipes which have withstood the same operating conditions without damage. From these observations, it is suggested that magnetization of the pipe walls causes, or at least exacerbates, corrosion of the metal.

Causes of this magnetization are thought to be the combination of thermal fluctuations and magnetic fields caused by flame patterns within a furnace which lead to variations in the magnitude and direction of magnetization along the pipes. These variations may bring about microscopic vortical currents within the pipes which cause or exacerbate corrosion.

In addition, patterns of magnetization found in pipes which have been damaged by corrosion indicate that significant magnetic fields are generated in a boundary layer of the boiling partially-dissociated water near the inner wall of the pipe. These fields are thought to result from thermal fluctuations and acoustic waves generated in a boundary layer of the boiling partially-dissociated water.

The present invention employs features for increasing the resistance of the pipe walls to magnetization, as well as otherwise disrupting corrosive processes which are operating on highly magnetized sections of pipe.

By way of example, the features of the present invention will be illustrated in the context of a steam generating boiler 10. Boiler 10 features a water circulation system 12 which includes two drums 13 between which run a number of pipes 14 which carry water 15 through flames generated within a furnace 16. Steam 17 generated within the boiler exits along steam supply line 19. Slime and waste is collected in a sump 21 at the base of lower drum 13 and is removed intermittently through a blow-off valve 23. The water content of boiler 10 is replenished through a water supply line 25 controlled by a stop valve 32.

Figure 2:
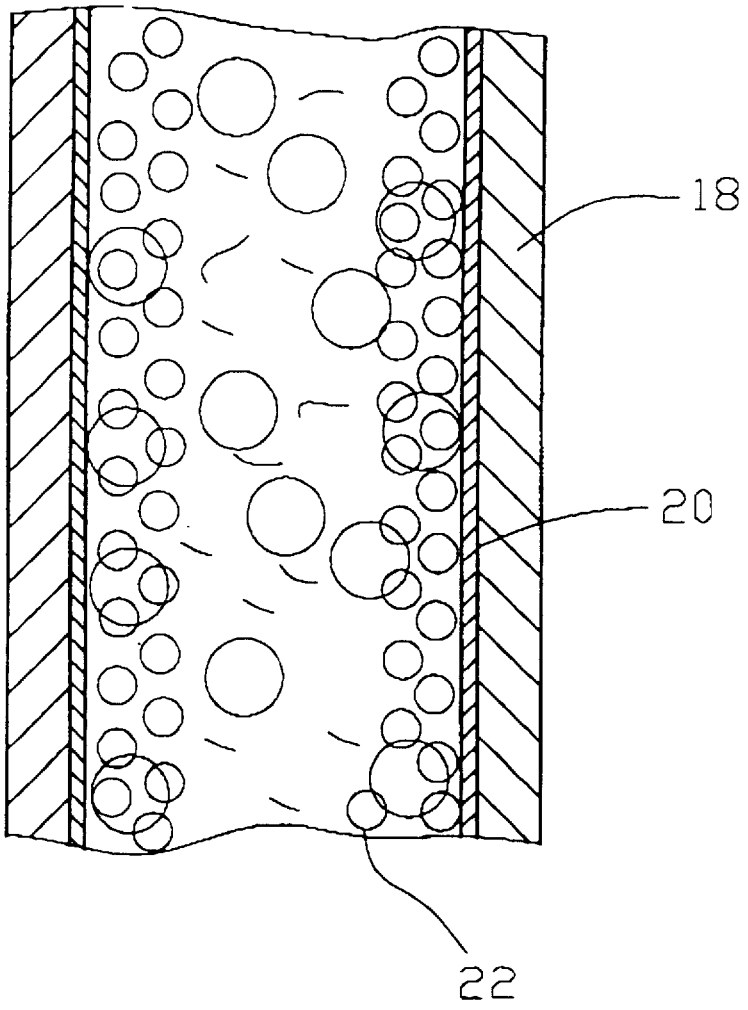
FIG. 2 is a longitudinal cross-sectional view through a heat-exchange pipe of the boiler of FIG. 1 during operation.

The structure of pipes 14 according to the first set of features of the present invention is shown more clearly in FIG. 2. Each pipe 14 is formed from high-carbon steel 18 and has a non-magnetic, electrically conductive inner lining 20.

Lining 20 is chosen to be a material which is thermally stable and structurally sound at the temperatures and physical conditions encountered near the inner surface of the pipes. Preferably, the material has a high thermal, as well as electrical, conductivity so as not to adversely affect the efficiency of heat exchange. Examples of suitable materials include, but are not limited to, a coating of copper metal, organosilicon with an admixture of copper, and fluoroplastic material with an admixture of copper. Typically, in the case of a copper metal coating, a thickness of between about 0.01 mm and about 0.25 mm is used.

The material of conductive lining 20 typically has an electrical conductivity which approximately an order of magnitude (in the case of elemental copper, about 20 times) greater than that of high carbon steel. As a result, lining 20 serves to equalize and remove electrical charge and currents induced in the walls of pipes 14 or the boundary layer of the water, thereby decreasing the rate of magnetization of the steel 18. Preferably, linings 20 of all of pipes 14 are connected together and to earth to form a single electrically grounded unit to further enhance their equalizing effect.

Preferably, steel 18 is also chosen to be a high carbon steel with a high intrinsic coercivity. This further reduces the rate of magnetization of pipes 14. To the extent that significant variations in coercivity exist between apparently similar pipes used in boiler construction, it is preferable to perform pre-testing of pipes to identify pipes with above-average coercivity. These should then be used during construction of the boiler for the most highly heat stressed regions while pipes with below average coercivity can be used in relatively cooler parts of the circulation system.

Without in any way limiting the scope of the present invention, it is believed that the magnetization of the pipes is a major factor both in the hydrogen embrittlement of the pipe walls and in the formation of scale. Thus, reduction of the rate of magnetization makes a major contribution to reducing both of these problems. In addition, lining 20 forms a physical barrier preventing contact of the hydrogen-containing water with the high-carbon steel 18. This physical barrier limits the surface interaction which causes hydrogen embrittlement.

Turning now to the second set of features of the present invention, boiler 10 is provided with a plurality of replaceable magnetized granules 22, located within the inner volume of circulation system 12, which are carried along with the water flow through pipes 14. Granules 22 preferably have an initial density similar to that of water under the normal operating pressure and conditions of the heat exchanger, typically in the range between about $0.5\times10^3$ and about $1.0\times10^3$ kg $m^{-3}$. This ensures that granules 22 are readily carried along with the water flow, whether in horizontal, vertical or otherwise angled pipes.

Because of their magnetization, they tend to collect near regions of magnetized pipe, and especially where the pipes are most highly magnetized. In these regions, in particular, granules 22 serve a number of functions. Firstly, granules 22 serve to reduce magnetic fields within the pipes. Since each granule 22 is effectively a small magnet, the granules tend to collect near highly magnetized portions of pipe and align with the local fields, thereby forming partially closed magnetic circuits and reducing the free magnetic flux within the pipes. As a result, any corrosion-exacerbating effects of magnetic flux within the pipes is lessened.

Secondly, granules 22 serve to collect scale. Granules 22 are preferably supplied in sufficient quantities that their total surface area is significantly greater, and typically orders of magnitude greater, than the inner surfaces area of the heat exchange pipes. As a result, surface deposition of scale occurs predominantly on surfaces of granules 22 rather than on the pipe surface.

Thirdly, to the extent that scale does form on the pipe surfaces, knocking of granules 22 against the pipe surfaces tends to dislodge the scale. Granules 22 are constantly in motion under the action of the water flow and steam bubbles formed on the surface of the pipes. As a result, the granules constantly strike the surfaces, knocking off deposited scale.

Finally, the movement of bubbles, granules and water near the surfaces intensifies heat exchange and correspondingly reduces the surface temperature of the pipe.

All the above factors combine to give profound reductions both of internal corrosion of the pipes and of scale deposition. This, in turn, increases the life-expectancy of the pipes and reduces the required frequency of washing out and other service procedures. While by no means eliminating the need for regular service procedures, the overall effect is a marked improvement in efficiency and profitability.

Granules 22 are preferably rounded in shape, and typically substantially spherical, although they need not be regular. It has been determined that optimal granule diameter under a broad range of conditions is between about 1 and about 10 mm. It may be preferable to include granules of a variety of different sizes mixed together.

It is a preferred feature of the present invention that the granule material has a heat capacity of less than about 0.1 kcal/kg degree, and typically between about 0.05 and about 0.1 kcal/kg degree. This ensures that the heat capacity is less than about one tenth of the heat capacity of water. This is of particular significance in peak load boilers which are typically started and stopped twice each day. The presence of a significant proportion of low heat capacity granules reduces the amount of heat wasted heating the boiler water on start-up.

The total volume of all of granules 22 generally corresponds to between about 15% and about 70% of the inner volume of water circulation system 12. Under most conditions, a proportion of between about 15% and about 45% of the volume is sufficient. However, in the aforementioned case of a peak-load boiler, it may be preferable to increase the proportion of granules up to between about 50% and about 70% of the circulation system volume, thereby decreasing the amount of heat needed to heat the working fluid by more than half.

As already mentioned, scale is deposited on the surface of granules 22 during boiler operation. Since the density of the scale is usually between 2.5 and $3.5\times10^3$ kg.$m^{-3}$, granules which have collected significant scale deposits become too heavy to be carried by the water flow. These heavy granules then collect at the bottom of the circulation system and are removed from the boiler on blow-off.

Figure 3:
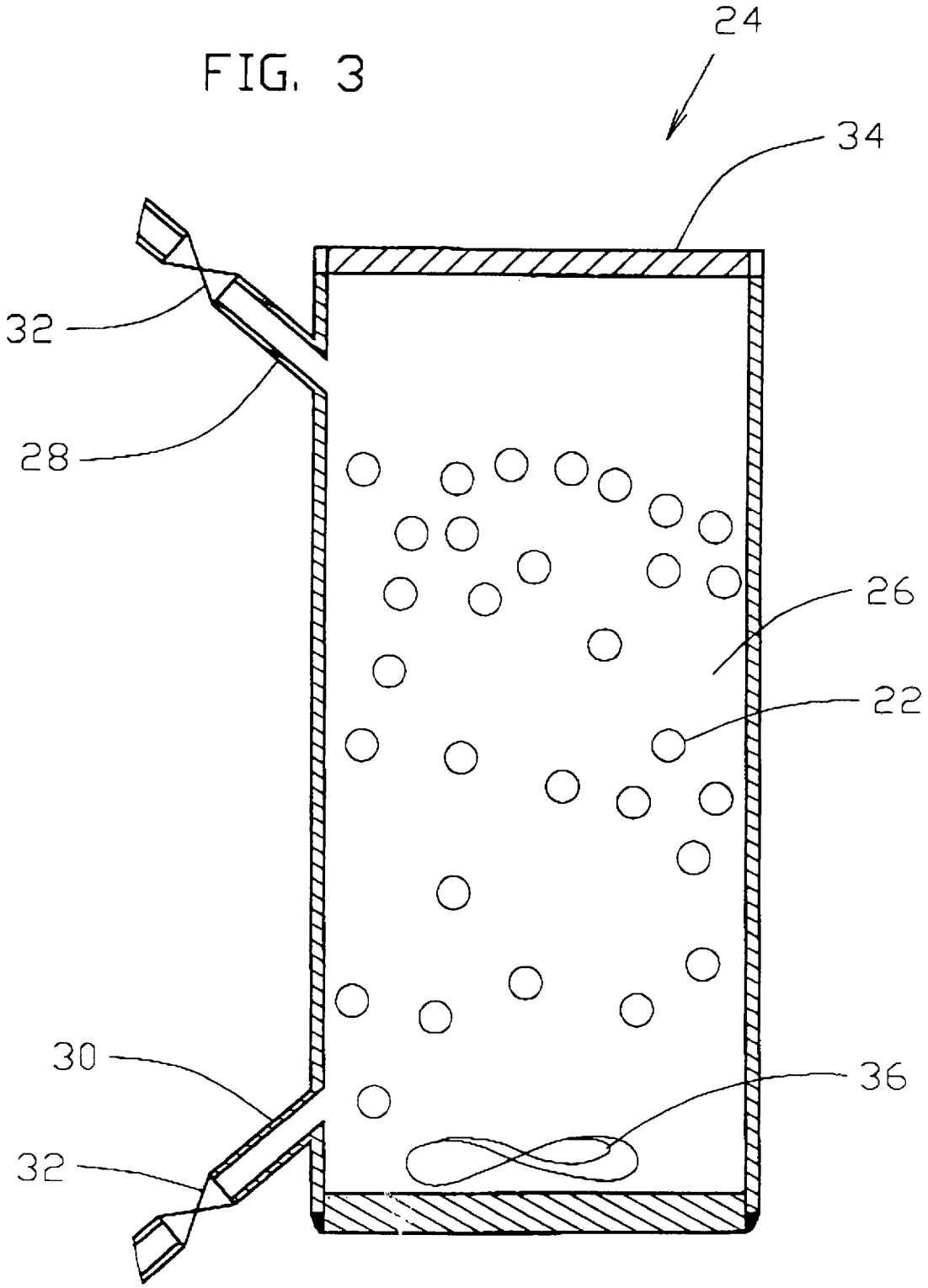
FIG. 3 is a cross-sectional view of a feeder device of the boiler of FIG. 1 for supplying magnetic granules into the boiler according to the teachings of the present invention.

In order to replace the portion of heavy granules which is removed from the boiler, a feeder device 24 is provided. An example of a simple implementation of feeder device 24 is shown in FIG. 3. Feeder device 24, as shown, may be implemented as a hermetic chamber 26 with upper and lower branch pipes 28, 30. Each branch pipe is provided with a stop valve 32 which is normally left closed. A hermetically closed cover 34 serves as a hatch for supplying granules 22. A built-in pump 36 is provided for producing flow within chamber 26.

When a portion of granules 22 is to be added to boiler 10, cover 34 is raised and the granules are added into chamber 26. Then, after sealing cover 34, valves 32 are opened and pump 36 is actuated to drive the granule-containing water through chamber 26 and out through upper branch pipe 28. Replacement water is simultaneously drawn in through lower branch pipe 30.

A number of different materials may be used for producing granules 22. These include, but are not limited to, magnetic porous glass, ceramic materials with a magnetic filler and thermo-stable polymeric materials with a magnetic filler.

By way of example, production of magnetic porous glass beads will now be briefly described. Porous glass or "foam glass" per se is known as a strong, lightweight construction material. It is typically produced by firing glass mixed with a carbon additive so that the combustion products form bubbles within the glass. By adjusting the proportions and conditions, the resultant density readily can be adjusted to between about 0.5 and about $1\times10^3$ km.$m^{-3}$, which is less than half that of non-porous glass.

Granules or beads of porous glass may be formed according to the present invention by scattering of glass crumb into a tapered punched-wall shaft where it is heated by a flow of descending flue gases and thermal radiation from surrounding bricks. The glass crumb undergoes fusion during free fall and is then collected at the bottom of the shaft and supplied to a separate chamber for a subsequent thermal treatment.

It should be noted that the term "porous" as used in this context does not imply that the glass is penetrable. In fact, to the contrary, the glass typically and preferably has a structure of mainly non-interconnected bubbles.

The porous glass is rendered magnetic by addition of magnetic compounds to the glass mix. Typically, the raw glass mix is combined with a carbon blowing additive such as coke or ore in a mix-to-ore ratio of between about 7:3 and about 9:1. According to preferred embodiments, the raw glass mix contains (in mol %): 35–63 $SiO_2$; 25–53 CaO; 7–20 $Fe_2O_3$; and 5–10 $Ga_2O_3$. The mix may be partially made up of broken glass granules. A number of specific examples of glass compositions and their properties are illustrated in Table 1.

TABLE 1

| Glass No. | 1 | 2 | 3 | 4 |
|---|---|---|---|---|
| $SiO_2$ | 40 | 63 | 35 | 35 |
| CaO | 33 | 25 | 53 | 35 |
| $Fe_2O_3$ | 20 | 7 | 7 | 20 |
| $Ga_2O_3$ | 7 | 5 | 5 | 10 |
| Fusion Temperature, °C. | 1400 | 1430 | 1450 | 1400 |
| Temperature of Softening, °C. | 780 | 820 | 845 | 770 |
| Volume resistivity, Ωcm | $5 \times 10^5$ | $7 \times 10^7$ | $7 \times 10^7$ | $7 \times 10^5$ |
| Curie point, °C. | 580 | 565 | 570 | 580 |
| Rel. magnetic permiability | 6 | 3 | 3 | 4 |

The above glasses also typically have a magnetic field of 100 A/m, a coercivity of H=6000 A/m, and an induction density of B=0.03 T. The transmittance of the glasses in the near infrared (2.5–8.5 $\mu$m) is about 70–85%.

It will be appreciated that the above descriptions are intended only to serve as examples, and that many other embodiments are possible within the spirit and the scope of the present invention.

What is claimed is:

1. A boiler in which water is heated by passing through a furnace, the boiler comprising:

(a) a water circulation system including a plurality of pipes for carrying water through the furnace, said water circulation system defining a contained volume; and (b) a plurality of magnetized granules located within said contained volume.

2. The boiler of claim 1, wherein said granules have a density of between about $0.5\times10^3$ and about $1.0\times10^3$ kg $m^{-3}$.

3. The boiler of claim 1, wherein the total volume of all of said granules corresponds to between about 15% and about 70% of said inner volume.

4. The boiler of claim 1, wherein said granules are made from magnetic porous glass.

5. The boiler of claim 1, wherein said granules are made from material with a magnetic filler.

6. The boiler of claim 1, wherein said granules are made from a thermo-stable polymeric material with magnetic filler.

7. The boiler of claim 1, wherein said granules are substantially spherical with diameters of between about 1 and about 10 mm.

8. The boiler of claim 1, further comprising a device for delivering said granules into said inner volume.

9. The boiler of claim 1, wherein each of said pipes is formed from high-carbon steel with a non-magnetic, electrically conductive inner lining.

10. A method for improving operation of a boiler having a water circulation system including a plurality of pipes for carrying water through a furnace, the water circulation system defining a contained volume, the method comprising feeding into the contained volume a plurality of magnetized granules.

11. The method of claim 10, wherein said granules have a density of between about $0.5\times10^3$ and about $1.0\times10^3$ kg $m^{-3}$ .

12. The method of claim 11, further comprising:

(a) removing some of said granules of which the effective density has been increased by deposition of scale; and (b) supplying replacement magnetic granules into the inner volume.

13. The method of claim 12, wherein the total volume of all of said granules is maintained between about 15% and about 70% of said inner volume.

14. The method of claim 12, wherein the total volume of all of said granules is maintained between about 15% and about 45% of said inner volume.

15. The method of claim 12, wherein said granules have a heat capacity of less than about one tenth of that of water, and wherein the total volume of all of said granules is maintained between about 50% and about 70% of said inner volume.

16. The method of claim 10, wherein said granules are made from magnetic porous glass.

17. The method of claim 10, wherein said granules are made from ceramic material with a magnetic filler.

18. The method of claim 10, wherein said granules are made from a thermo-stable polymeric material with a magnetic filler.

19. The method of claim 10, wherein said granules are substantially spherical with diameters of between about 1 and about 10 mm.

* * * * *